US007843293B1

(12) United States Patent
Bonjean et al.

(10) Patent No.: US 7,843,293 B1
(45) Date of Patent: Nov. 30, 2010

(54) BISTABLE MAGNETIC DRIVE FOR A SWITCH

(75) Inventors: Marc Bonjean, Liége (BE); Roger Nicolaye, Stembert (BE)

(73) Assignee: E.I.B.S.A., Dison (BE)

( * ) Notice: Subject to any disclaimer, the term of this patent is extended or adjusted under 35 U.S.C. 154(b) by 0 days.

(21) Appl. No.: 09/700,043

(22) PCT Filed: Feb. 18, 2000

(86) PCT No.: PCT/EP00/01314

§ 371 (c)(1),
(2), (4) Date: Jun. 15, 2001

(87) PCT Pub. No.: WO00/54295

PCT Pub. Date: Sep. 14, 2000

(30) Foreign Application Priority Data

Mar. 9, 1999 (DE) ..... 199 10 326

(51) Int. Cl.
*H01H 3/00* (2006.01)

(52) U.S. Cl. ..... 335/230; 218/154

(58) Field of Classification Search ..... 335/220–229, 335/253, 78, 230–236; 218/84, 120, 140, 218/153, 154
See application file for complete search history.

(56) References Cited

U.S. PATENT DOCUMENTS

| | | | | |
|---|---|---|---|---|
| 3,523,271 | A * | 8/1970 | Miles | 335/230 |
| 3,683,239 | A | 8/1972 | Sturman | |
| 3,944,957 | A * | 3/1976 | Kotos et al. | 335/174 |
| 4,072,918 | A | 2/1978 | Read, Jr. | |
| 6,130,594 | A * | 10/2000 | Morant et al. | 335/230 |
| 6,598,621 | B1 * | 7/2003 | Wygnanski | 137/624.18 |
| 7,280,019 | B2 * | 10/2007 | Kolb et al. | 335/229 |
| 2008/0169890 | A1 * | 7/2008 | Irwin | 335/228 |

FOREIGN PATENT DOCUMENTS

| | | |
|---|---|---|
| DE | 2419732 | 11/1975 |
| DE | 1-9619835 | 11/1997 |
| DE | 1961983-5 | 11/1997 |
| DE | 1962565-7 | 1/1998 |
| EP | 0-867903 | 9/1998 |
| WO | 9933078 | 7/1999 |

* cited by examiner

*Primary Examiner*—Elvin G Enad
*Assistant Examiner*—Bernard Rojas
(74) *Attorney, Agent, or Firm*—Harness, Dickey & Pierce, P.L.C.

(57) ABSTRACT

Disclosed is a magnetic drive for an electrical switch, including a linear armature (26) displaceable between two ends positions, a shunt body (27) mounted at a distance from said armature and means (24, 25, 30, 31) for generating a magnetic field. The magnetic field exerts a force on the armature (26) retaining the latter in the end positions. By joining the shunt body (27) with the armature (26), the course of the flow lines of the magnetic field are changed in such a way that the retaining force exerted on the armature (26) is reduced and the latter is displaced to the other end position, optionally by a force exerted externally on the armature (26), and retained in the position by the magnetic field. Disconnection is effected by the shunt body (27), were after being joined with the shunt body (27) the armature (26) is moved from the end position opposite the shunt body (27) to the end position facing the shunt body (26). Fixing means (37-40, 42-45) are especially provided which hold the shunt body (27) in the end position opposite said shunt body and which joins the shunt body with the armature (26) when the electric switch (1) is disconnected requiring little energy/force expenditure.

16 Claims, 8 Drawing Sheets

BISTABLE MAGNETIC DRIVE FOR A SWITCH

BACKGROUND OF THE INVENTION

1. Field of the Invention

This application is the national phase under 35 U.S.C. §371 of PCT International Application No. PCT/EP00/01314 which has an International filing date of Feb. 18, 2000, which designated the United States of America.

The present invention relates to a bistable magnetic drive or solenoid actuator for a switch, in particular for an electric switch having an armature that works together with at least one movable switch contact and is linearly displaceable between two end positions in a space, having a shunt body formed by a magnetizable material arranged essentially on the axis of displacement of the armature and at a distance from the armature, as well as having means for generating a magnetic field which exerts a force on the armature, holding it in the end positions, in which case by combining the shunt body with the armature, the course of the flow lines of the magnetic field is altered such that the holding force acting on the armature is reduced.

2. Related Art

Magnetic drives of the respective type are usually used in the field of electric switching technology, especially in power circuit breakers which cause a rated current or an overload current to be switched on and off under specified conditions and which also isolate electric circuits from one another. Since these switches have two stable states, namely an opened state where the electric isolation of the respective circuits is maintained, and a closed state where the defined rated current flows continuously and an overload current is withstood for a certain period of time, it is necessary in particular for the drives used in the switches to also have two stable states, i.e., idle states, which necessitate holding forces.

A bistable magnetic drive for an electric switch of the type defined above is known from Unexamined German Patent No. 196 19 835, to which reference is herewith made to the full extent. This magnetic drive has an armature that is connected to at least one movable switch contact and is linearly displaceable between two end positions; the armature is held in the end positions in a stable manner under the influence of magnetically generated forces. In addition, a ferromagnetic shunt body is also provided, with the armature and shunt body being arranged in succession in a space between a first and a second stop. The stops are designed as pole faces of magnetic circuits induced by a pair of permanent magnets that hold the displaceable armature in the two stable end positions. Furthermore, there is also a pair of electromagnets whose variable magnetic fields serves to move the armature between the two stable end positions. The shunt body serves in particular to reverse the direction of the force exerted by the permanent magnet on the armature, optionally with a force exerted on the armature from the outside, by applying the shunt body to the armature, and to transfer this force to the shunt body, so that the shunt body and the armature are shifted to the second stable end position and held there.

The magnetic circuit is thus designed so that the force lines of the permanent magnets are closed outside of the armature and the shunt body, depending on whether the armature and the shunt body are arranged separately from one another or side by side, so that the force exerted by the permanent magnets is directed into one of the two directions of motion of the armature and the shunt body.

In the case of the known drive, the armature may assume two stable positions, where it is in contact with the first stop on the one end and on the other end is in contact with the shunt body, which is in turn in contact with the second stop in the second stable position of the armature. This prevents the armature which drives the movable contact from becoming "stuck" in an intermediate position between the two end positions. When the reversal of the armature positions is initiated by turning on the electromagnets or by applying the shunt body to the armature, the switching process takes place automatically and rapidly. Despite the relatively low opening energy, no stable intermediate position between the two end positions of the armature is possible, i.e., once a switching operation has been initiated, it necessarily leads to opening or closing of the switch.

It is a special requirement of the switches in question here that the fastest and most reliable shutdown, in particular in an emergency situation ("emergency cutoff") must be guaranteed. Therefore, technically complicated additional mechanical devices (e.g., lever devices) must be provided with the known switches, so that the armature can be moved into the "OFF" position of the switch, and meanwhile the cutoff can be accomplished only at a relatively great expenditure of energy.

SUMMARY OF THE INVENTION

Thus, the object of the present invention is to improve upon a magnetic drive of the type described hereinabove in such a way as to minimize the force and power that must be expended in shutdown of the power circuit breaker operated with the drive and thus increase operating reliability on the whole, in particular to the extent that an emergency cutoff can be accomplished as rapidly and as reliably as possible. At the same time, the technical design of the drive should be as simple as possible with regard to its production to ultimately minimize manufacturing costs. In addition to these requirements, however, the use of a shunt body of the type defined in the preamble with the special advantage of a lower force expended in movement of the armature should not be omitted.

The object is achieved with a magnetic drive of the type defined above according to the present invention by providing a lock for the shunt body by means of which the shunt body can be held in the end position facing it and can be released from this end position with little expenditure of force or power. With this lock, the shunt body can be brought together with the armature relatively rapidly and with little expenditure of force or power in a shutdown operation, in particular in the case of an emergency cutoff of the electric switch that has been operated.

According to the present invention, the shunt body is used to advantage in cutting off the switch. For the break time, the rate of movement of the shunt body in particular is the deciding factor. However, this requirement is taken into account precisely through the proposed mechanical holding device due to the fact that the shunt body can be released from its holding position with little expenditure of force or power and therefore also relatively rapidly.

According to a first embodiment of the present invention, the strict safety requirements for trouble-free functioning of a cutoff of a switch operated with the magnetic drive according to the present invention, in particular in the case of an emergency cutoff, are met by the fact that the shunt body can be locked in the end position by means of mechanical holding means. The proposed mechanical holding means for the shunt body is less susceptible to trouble in comparison with electric or magnetic holding devices, for example, and furthermore, it is still fully functional in an emergency situation, which is often associated with a power outage.

According to a preferred embodiment of the magnetic drive according to the present invention, the mechanical holding means are implemented by a mechanical lock by means of which the shunt body is held in the end position facing the shunt body, with a spring force acting on the shunt body in the direction of the armature after releasing the lock. Therefore, in this embodiment, because of a mechanical compressive spring, for example, the shunt body experiences a supporting force for the motion in the direction of the armature, which counteracts the force produced by the permanent magnet(s) and automatically acts on the shunt body as soon as the mechanical holding device of the shunt body has been released.

In the case of the mechanical holding means, a mechanical lock of the shunt body may in particular have a guide rod connected to the shunt body and pivotable connected to a lever arm that works together with a touch device.

As an alternative, a mechanical threshold or barrier by means of which the shunt body is held detachably in the end position facing the shunt body by a slight holding force may be provided so that the shunt body can be released from this end position by overcoming this low force potential and can be brought together with the armature.

According to another embodiment of the magnetic drive according to the present invention, the shunt body may be lockable in the end position by means of a magnetic holding device.

Additional features, details and advantages of the present invention are derived from the accompanying claims and on the basis of an embodiment of the magnetic drive according to the present invention as illustrated in the drawings, which show:

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
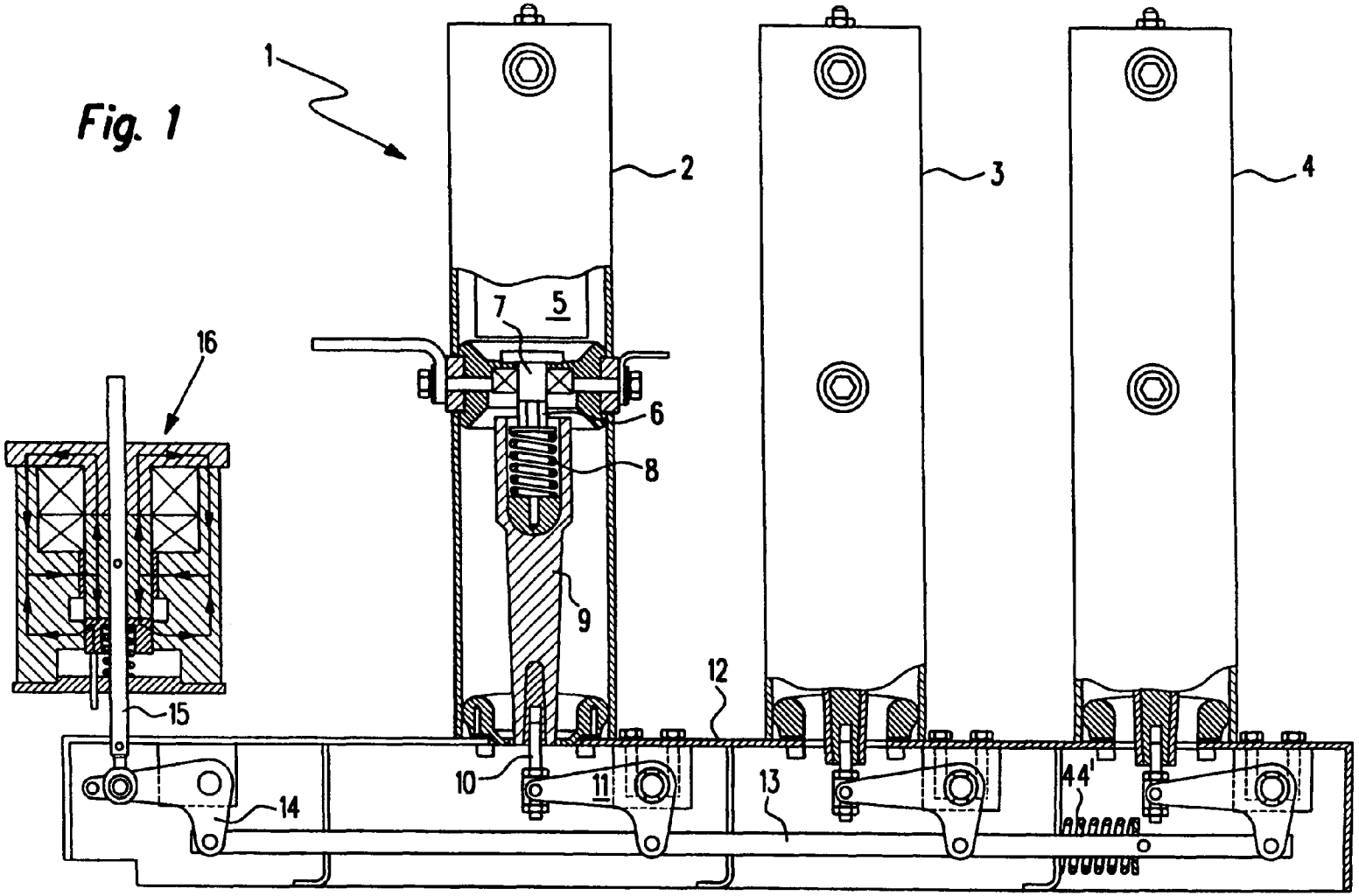
FIG. 1 is a side view of a medium- or high-voltage power circuit breaker having a linear magnetic drive according to the present invention, and partially in cross section.

With reference to FIG. 1, first the use of a magnetic drive according to the present invention is described in the case of a medium- or high-voltage power circuit breaker. A power circuit breaker 1 contains three switch poles 2, 3, 4, each having an interrupter chamber 5 containing a stationary switch contact (not shown in detail) and a mobile switch contact (also not shown). Interrupter chamber 5, e.g., a vacuum interrupter, is of a traditional design. The movable switch contact is connected to an axle 7 which is mounted so that it can be displaced along a shaft 6 under the prestress of a spring 8. In the on or closed position of the power circuit breaker, springs 8 of switch poles 2, 3, 4 are stretched, i.e., the springs relax on opening of the power circuit breaker. Therefore, the movement of axle 7 which is necessary for a shutdown is supported by the spring force of springs 8 or by a so-called tripping spring (44 in FIG. 1). The shaft 6 is rigidly connected to a rod 9 which is connected, e.g., by means of a bolt 10, in an articulated joint to one end of a pivotably mounted toggle 11, whose other end is connected in an articulated joint to a rod 13, which is displaceable at a right angle to the rod 9, in a housing 12. The housing 12 has switch poles 2, 3, 4 arranged in a row.

At one end of the rod 13 is connected one end of another pivotably mounted toggle 14 in the housing 12 in an articulated connection, its other end being connected to a rod 15 in an articulated connection, its other end in turn being connected to a linear magnetic drive 16 according to the present invention.

A preferred embodiment of the magnetic drive according to the present invention is described below, where identical parts illustrated in the different figures are labeled with identical reference numbers.

Figure 2B:
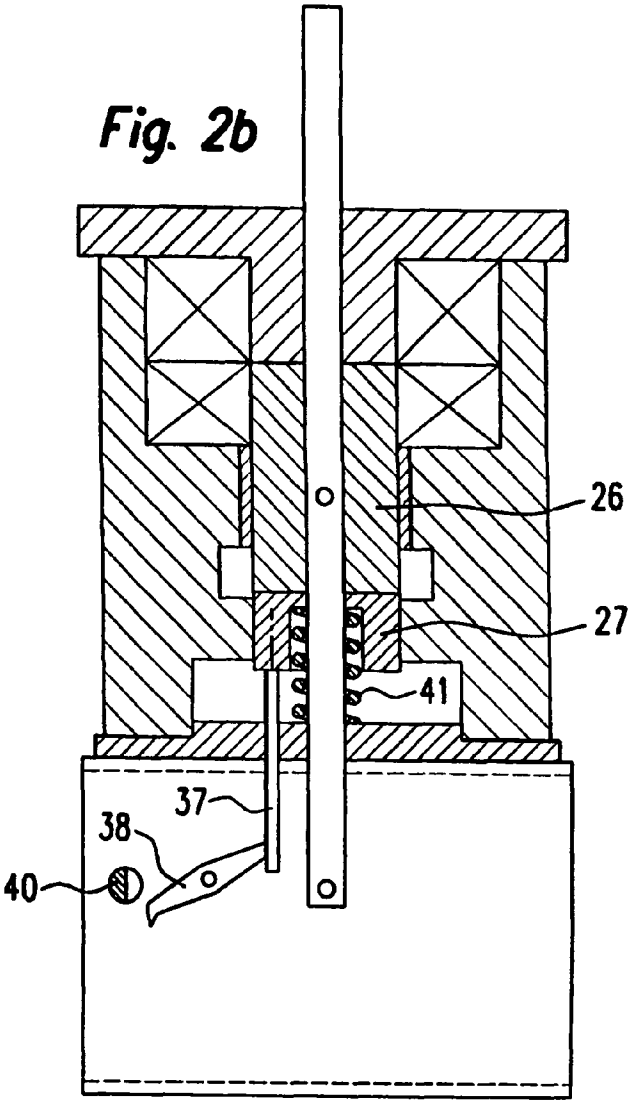
FIGS. 2*a-b* are schematic side views of a magnetic drive according to the present invention, having an armature and shunt body, each having two different positions.
Figure 2A:
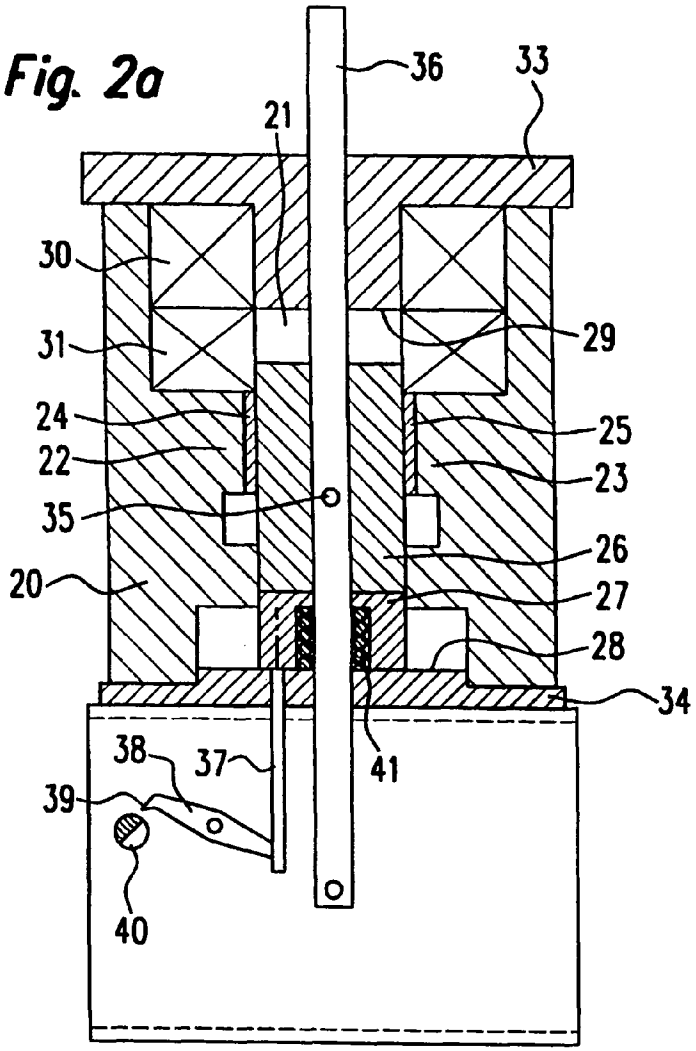

The linear magnetic drive 16 illustrated in FIGS. 2*a* and 2*b* (FIG. 2*a* for an opened switch 1 and FIG. 2*b* for a closed switch) has a rectangular yoke 20 made of a magnetic material, e.g., laminated sheets of soft iron, on the outside. The external form of the yoke 20 is not significant for the present invention and may be selected freely within the scope of all conceivable forms, e.g., a cylindrical shape. In the inside area of the yoke 20, a recessed space 21 is provided, with pole shoes 22, 23 projecting inward into this space on two opposite sides. Permanent magnets 24, 25 are arranged on the inside faces of the pole shoes 22, 23. However, the permanent magnets 24, 25 may also be designed in one piece, in which case they surround space 21 in a ring at the level of the pole shoes 22, 23. The permanent magnets 24, 25 have the same poles facing one another and thus form a corresponding magnet pair.

An armature 26 and a shunt body 27 are arranged one after the other so that they are linearly movable in the space 21 inside the yoke 20. Both armature 26 and the shunt body 27 are preferably made of a magnetizable material, preferably a magnetizable metal. The space for movement of the armature 26 and the shunt body 27 is bordered at one end by a first stop 28 and at the other end by a second stop 29. At the side, the movement space of the armature 26 is also bordered by the permanent magnets 24, 25.

In addition, a coil 30 for opening the switch 1 and a coil 31 for closing the switch 1 are provided above the permanent magnets 24, 25 and outside the movement space 21 of the recesses provided in the yoke 20. The magnetic field generated by the coil 31 thus permits or produces an armature movement in the direction of the second stop 29, whereas the magnetic field generated by the coil 30 permits or produces an armature movement in the direction of the shunt body 27.

The movement space for the armature 26 and the shunt body 27 is bordered at the top by a top plate 33 introduced into the recess in the yoke 20 and at the bottom by a corresponding bottom plate 34.

Furthermore, the armature 26 has a clearance hole 35 into which a bolt (not shown) can be inserted to attach the armature 26 to a shaft 36 passing through the yoke 20 the, shunt body 27 and the armature 26. The motion of the armature 26 is transmitted by the shaft 36 to the switch arrangement illustrated in FIG. 1, or through the toggle 14 illustrated in FIG. 1.

In this embodiment, the shunt body 27 is secured in the position provided on the first stop 28 of the bottom plate 34 by means of a locking mechanism. In particular, a guide rod 37 is mounted on the shunt body 27 and is in turn pivotably connected to an articulated joint 38. The joint 38 is held in the position illustrated here by a lug 39 which works together with a half-shaft 40 in the rotational direction of the half-shaft 40 shown here, so that shunt body 27 is in turn secured on the first stop 28.

In the case of an alternative embodiment, the shunt body 27 is held by means of a mechanical threshold (barrier) (not shown in this illustration), which may be designed as a restraining spring, for example, where the shunt body 27 can be 'released' by overcoming a spring force potential. Those skilled in the art are familiar with corresponding holding devices from many fields of the art.

In the case of the situation illustrated in FIG. 2*b*, the armature 26 is in contact with the upper stop 29 of the upper plate 33 and the shunt body 27 is in turn in contact with the armature 26. The required movement of the shunt body 27 is first induced by the fact that the lug 39 is no longer in contact with the upper half-shaft 40 due to the rotation of the half-shaft 40, and thus the joint 38 can move freely. Because of the spring force of a compressive spring 41, the shunt body 27 thus moves in the direction of the clearance released by the movement of the armature 26 until it is in contact with the armature 26.

Figure 3:
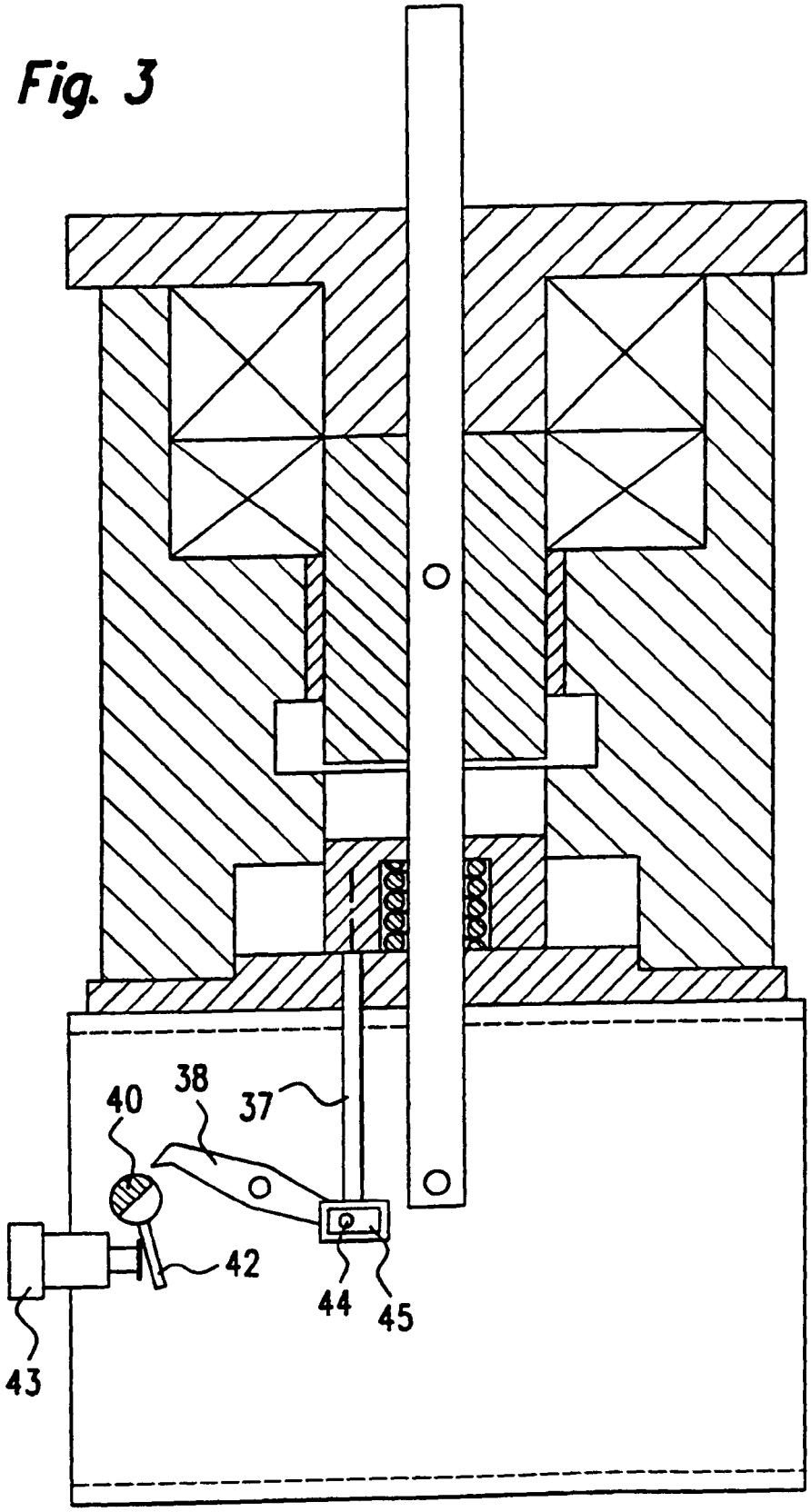
FIG. 3 is the embodiment of the magnetic drive illustrated in FIGS. 2*a* and 2*b* in a schematic side view with a detailed diagram of a mechanical lock according to the present invention for the shunt body.

FIG. 3 shows in detail a preferred embodiment of a lock mechanism according to the present invention. In this embodiment, a bolt or a strap 42 is mounted on the half-shaft 40, executing the rotational movement of the half-shaft 40 which is necessary for the operation of the lock, by means of an externally controllable mechanical motion device, namely a pushbutton 43 here. The pivotable connection between the guide rod 37 and the joint 38 is implemented in the present embodiment by a bolt 44 which is mounted on the guide rod 37 and engages in a recess provided on one end of the joint 38. The design of the continuous elongated hole 45 shown here is essentially predetermined because of the play determined by the rotational movement of the joint.

Figure 4B:
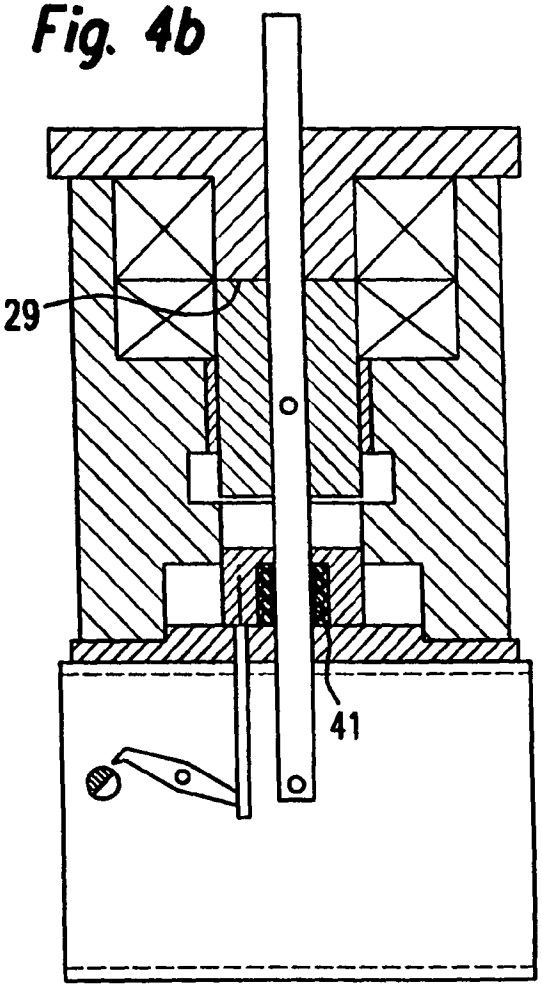
FIGS. 4*a-c* are side views according to FIG. 3 representing three different operating phases of the magnetic drive.
Figure 4A:
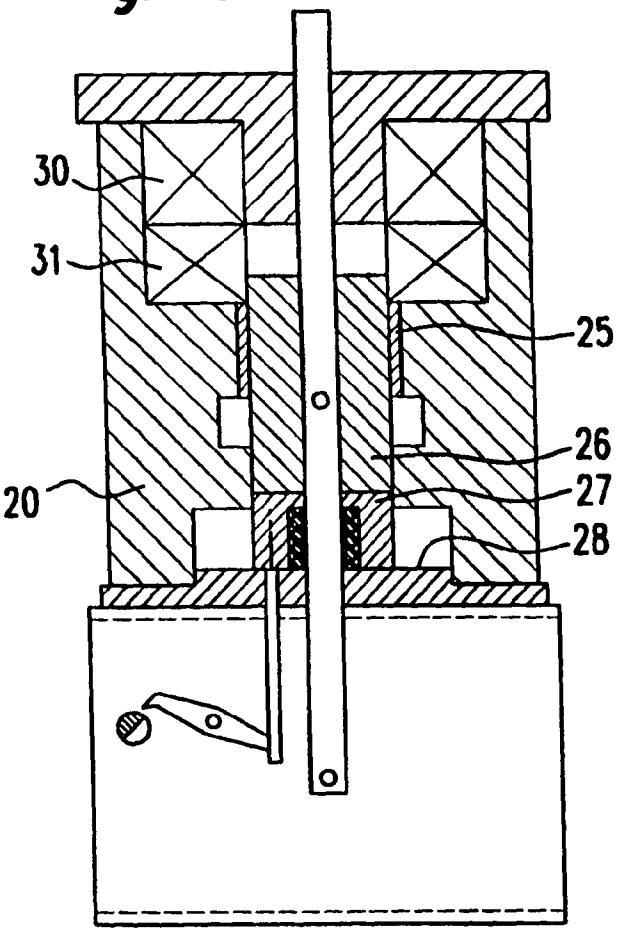
Figure 4C:
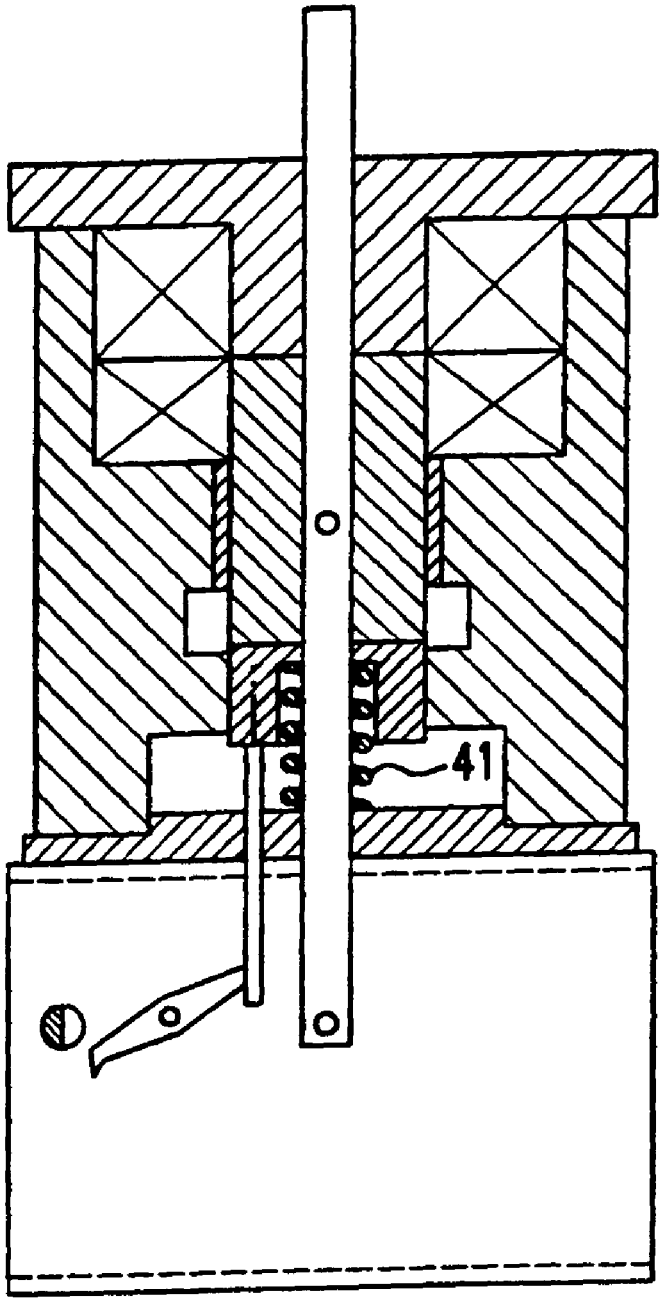

Various operating phases of the magnetic drive according to the present invention are described on the basis of FIGS. 4*a* through 4*c*.

In FIG. 4*a*, the armature 26 is in one of the two stable end positions, with the switch 1 which is operated by the magnetic drive being in the "open" position ("off"). In this stable end position, both the armature 26 and the shunt body 27 are positioned at the lower first stop 28 of the yoke 20.

In the situation illustrated in FIG. 4*b*, the armature 26 has moved upward on the whole due to the magnetic field generated by the permanent magnets 24, 25 and the electromagnet 31 by superpositioning, and the armature 26 is then at the second stop 29. This second stable end position of the armature 26 is characterized in particular by the fact that the armature 26 and the shunt body 27 are separated from one another. This separation is achieved by the locking mechanism illustrated in FIG. 3. However, the stability of the end position of the armature 26 shown here is achieved essentially through the action of the field emanating from the permanent magnets 25. The phenomenology of the magnetic field forming the basis of this effect and its force acting on the armature 26 are explained in greater detail below on the basis of FIGS. 5*a* through 5*f*.

The stable end position illustrated in FIG. 4*b* is returned to an unstable state by means of the shunt body 27, corresponding to the situation illustrated in FIG. 4*c*. By releasing the lock, the shunt body 27 moves in the direction of armature 26 due to the spring action of the compression spring 41, and it is thus in contact with it. Because of the resulting change in the course of the magnetic flux lines, there is then a reversal of forces downward, so that armature 26 together with shunt body 27 can move downward again under a relatively low force, thus leading again to the situation illustrated in FIG. 4*a*, where the armature 26 assumes the other stable end position.

FIGS. 5*a* through 5*e* show simplified side views, partially cut away, of the magnetic drive according to the present invention, already illustrated in FIGS. 2 through 4. In particular, the positions of armature 26 and shunt body 27 during five different operating phases of the magnetic drive are shown. Furthermore, to illustrate the operation, the magnetic field lines 50 prevailing in the individual operating phases are also drawn in schematically.

Figure 5B:
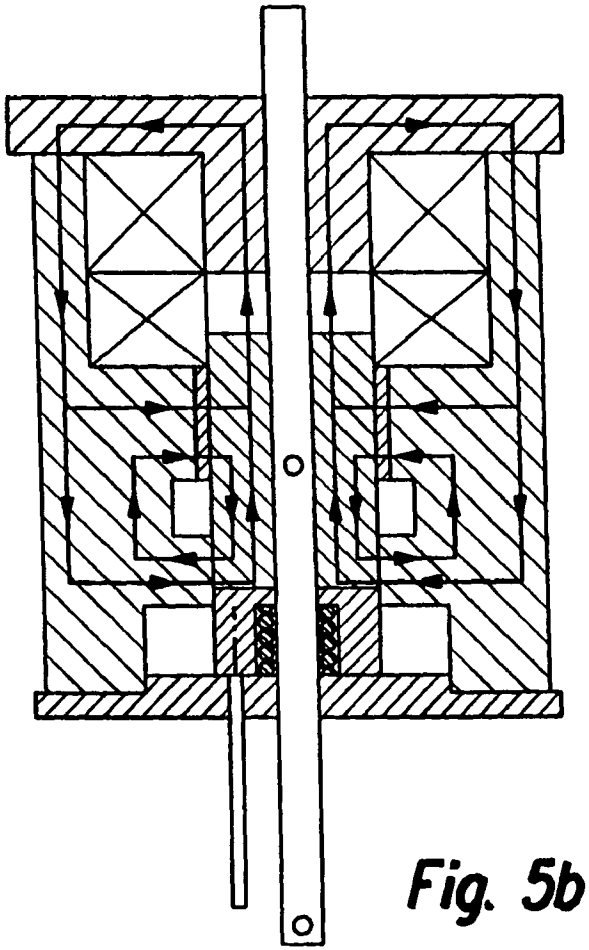
FIGS. 5*a-e* are schematic side views of the magnetic drive according to the present invention during six different operating phases and the corresponding magnetic field lines.
Figure 5A:
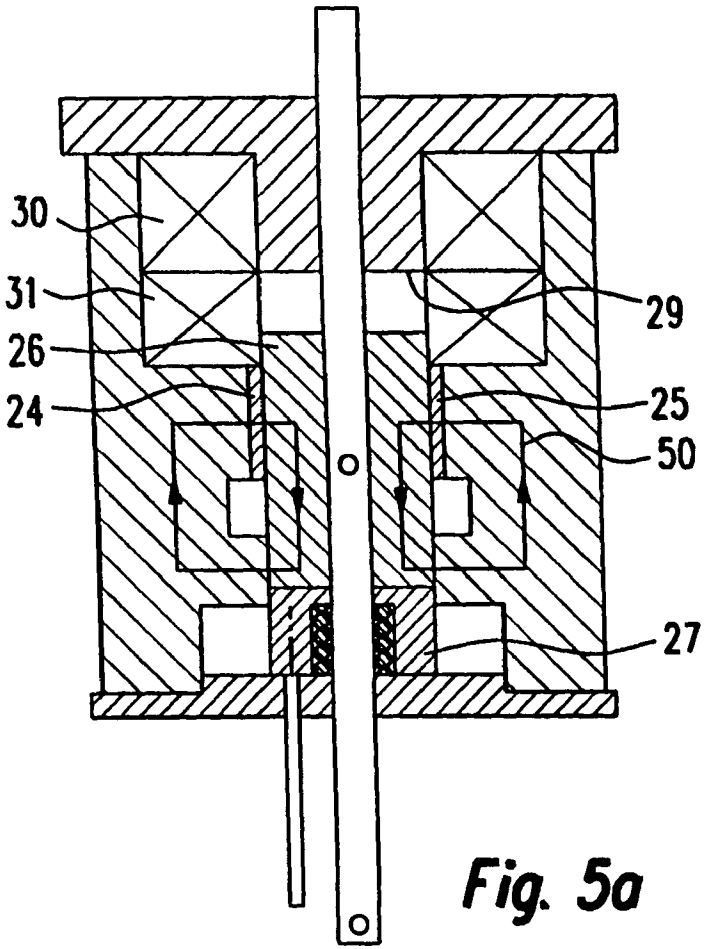
Figure 5D:
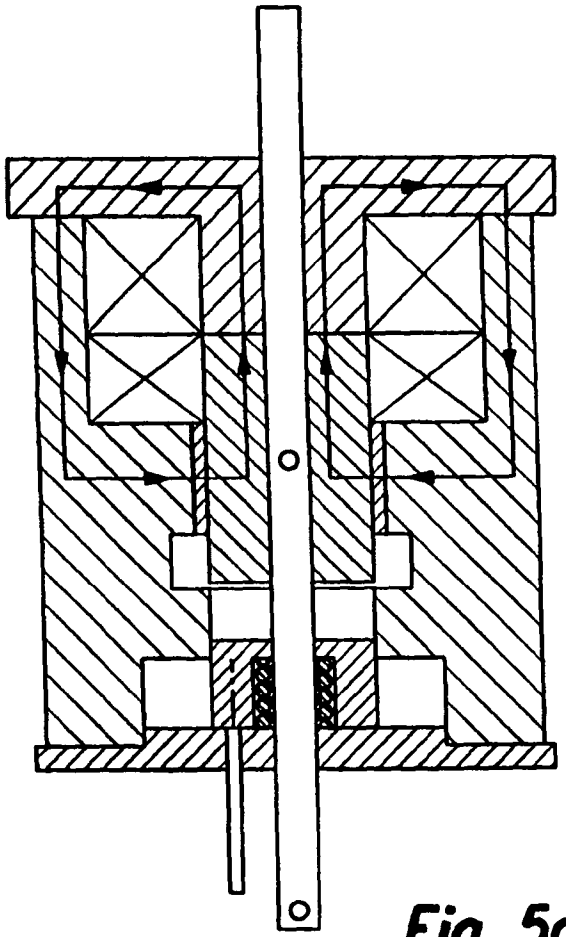
Figure 5C:
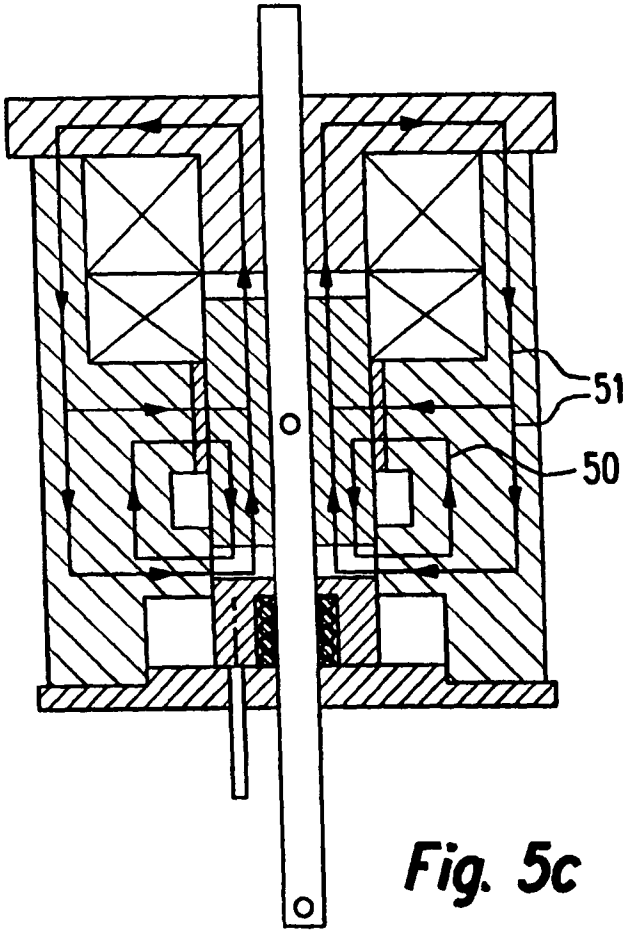
Figure 5E:
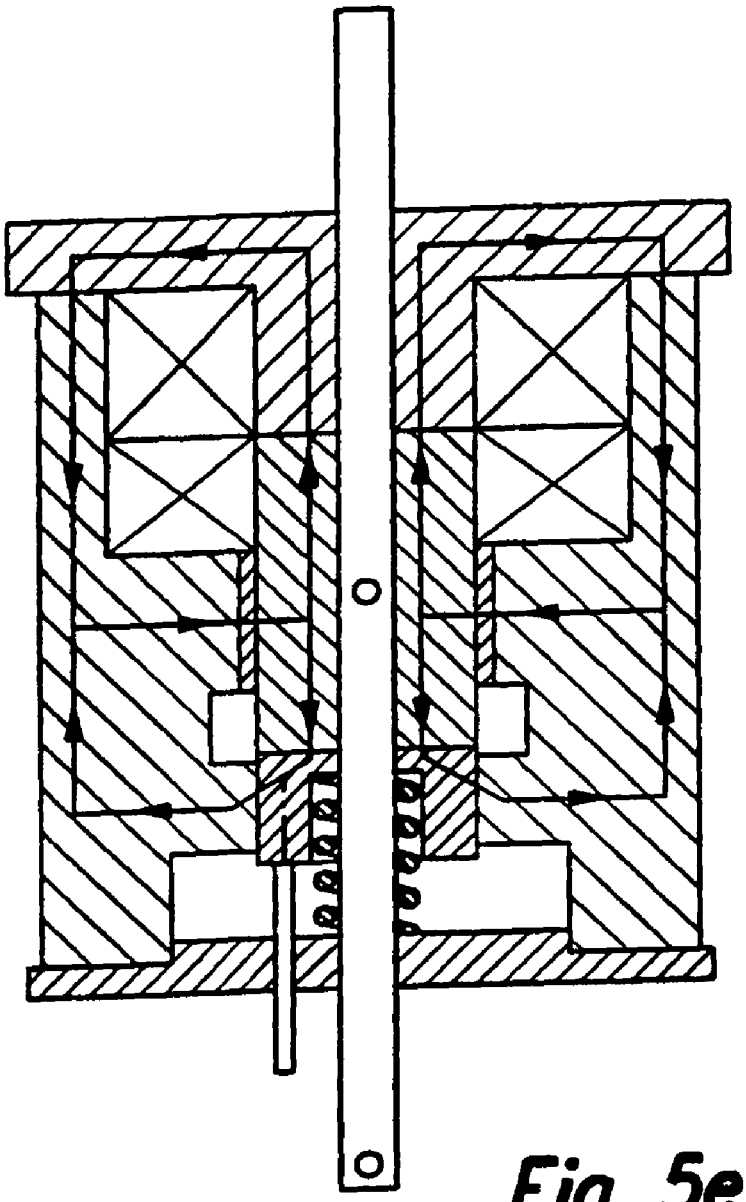

FIG. 5*a* shows the drive in the open position ("off") of the power circuit breaker. FIG. 5*b* shows the situation at the start of the movement of the armature 26 into the closed position ("on") of the power circuit breaker. FIG. 5*c* shows the magnetic field distribution during the turn-on phase, where the armature 26 is in a middle position on the path to the closed position of the power circuit breaker. FIG. 5*d* shows the magnetic field distribution in the closed position ("on") of the power circuit breaker. FIG. 5*e* shows the phase at the start of the movement of the armature into the open position ("off") of the power circuit breaker, where the shunt body 27 has already been brought in contact with the armature 26.

During the operating phases of the magnetic drive illustrated in FIGS. 5*a* through 5*d*, the shunt body 27 is held on the first stop 28 by means of the holding device (not shown here) according to the present invention, so that the armature 26 can move toward second stop 29 under the influence of the magnetic field 51—separating from the shunt body 27.

In FIG. 5*e*, the shunt body 27 moves in the direction of armature 26 because of the action of spring 41 and it approaches the stop after the lock (not shown here) has been released.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A magnetic drive for a switch, in particular for an electric switch (1) having an armature (26) which is linearly displaceable between two end positions of a space (21), with at least one moveable switch contact, having a shunt body (27) made of a magnetizable material and arranged at a distance from the armature (26) essentially on the axis of displacement of the armature (26), and having means (24, 25, 29, 31) for generating a magnetic field which exerts a retaining force on the armature (26) holding it in the end positions (28, 29), where the course of the flux lines of the magnetic field is altered by bringing the shunt body (27) together with the armature (26) so that the retaining force acting on the armature (26) is reduced, wherein a lock means for the shunt body (27), by which the shunt body (27) can be held in the end position (28) facing the former and can be released from the end position (28) by exerting a low force or power.

2. The magnetic drive according to claim 1, wherein the shunt body (27) can be locked in the end position (28) by means of mechanical holding devices (37-40, 42-45).

3. The magnetic drive according to claim 2, wherein the mechanical holding devices are provided in the form of a mechanical lock (37-40, 42-45) by means of which the shunt body (27) can be held in the end position (28), and a spring force (41) acts on the shunt body (27) in the direction of the armature (26) after the lock has been opened.

4. The magnetic drive according to claim 2, wherein a mechanical threshold is provided as the mechanical holding device by means of which the shunt body (27) can be retained in the end position (28) and can be brought together with the armature (26) with a slight force or power.

5. The magnetic drive according to claim 1, wherein the shunt body (27) can be locked in the end position (28) by means of the magnetic holding means.

6. The magnetic drive according to claim 2, wherein the mechanical lock (37-40, 42-45) of the shunt body (27) has a guide rod (37) which is connected to the shunt body (27) and which is pivotably connected to a lever arm (38) which works together with a touch device.

7. The magnetic drive according to claim 1, wherein the electric switch (1) is closed in the end position of the armature (26) facing away from the shunt body (27), and it is open in the end position of the armature (26) facing the shunt body (27).

8. The magnetic drive according to claim 1, wherein the armature (26), the yoke (20) and the upper plate (33) are provided with slots to prevent eddy currents.

9. A magnetic drive for an electric switch, the electric switch including an armature linearly displaceable between two end positions of a space, the electric switch including at least one moveable switch contact, the magnetic drive comprising:

a shunt body made of a magnetic material and configured to be at a distance from the armature substantially on the axis of displacement of the armature;

at least one magnet and a coil configured to generate a magnetic field to exert a retaining force on the armature holding the armature in the end positions, such that the course of the flux lines of the magnetic field are altered by bringing the shunt body together with the armature such that the retaining force acting on the armature is reduced; and a lock configured to hold the shunt body in the end position facing and such that the shunt body can be released from the end position by exerting a low force.

10. The magnetic drive according to claim 9, comprising:

one or more mechanical holding devices configured to lock the shunt body the end position.

11. The magnetic drive according to claim 10, wherein the mechanical holding devices include, a mechanical lock configured to hold the shunt body in the end position, and a spring configured to apply a force on the shunt body in the direction of the armature after the lock has been opened.

12. The magnetic drive according to claim 10, wherein the mechanical holding devices include a mechanical threshold configured to retain the shunt body in the end position and configured to bring the shunt body together with the armature with a slight force.

13. The magnetic drive according to claim 9, wherein the at least one magnet and the coil are configured to lock the shunt body in the end position.

14. The magnetic drive according to claim 10, wherein the mechanical holding devices include a guide rod connected to the shunt body and the guide rod is pivotably connected to a lever arm configured to operate together with a touch device.

15. The magnetic drive according to claim 9, wherein the electric switch is configured to be closed in the end position of the armature facing away from the shunt body, and the electric switch is configured to be open in the end position of the armature facing the shunt body.

16. The magnetic drive according to claim 9, wherein the armature, the yoke and the upper plate include slots to prevent eddy currents.

* * * * *